United States Patent [19]

Allen

[11] 4,214,383

[45] Jul. 29, 1980

[54] STORABLE SLIPPERS

[75] Inventor: James H. Allen, Covington, Ky.

[73] Assignee: 'Totes', Incorporated, Loveland, Ohio

[21] Appl. No.: 950,565

[22] Filed: Oct. 12, 1978

[51] Int. Cl.[2] ..... A43B 3/24

[52] U.S. Cl. ..... 36/1; 36/101

[58] Field of Search ..... 36/1, 100, 101, 102, 36/136, 9 R, 9 A

[56] References Cited

U.S. PATENT DOCUMENTS

| | | | |
|---|---|---|---|
| 794,561 | 7/1905 | Spencer | 36/1 |
| 902,573 | 11/1908 | Fleck | 36/1 |
| 1,300,998 | 4/1919 | Nelson | 36/1 |
| 2,200,080 | 5/1940 | Fein | 36/101 |
| 3,041,743 | 7/1962 | Monsma | 36/1 |
| 3,889,399 | 6/1975 | Emrich | 36/1 |

*Primary Examiner*—Patrick D. Lawson

*Attorney, Agent, or Firm*—Wood, Herron & Evans

[57] ABSTRACT

A pair of slippers each of which, in preferred form, has one-half of a slide fastener connected around substantially the entire periphery of the slipper's sole. The slide fastener half remains connected to each slipper while the slippers are being worn. To store the slippers, the slippers are oriented in toe-to-toe position, and in upper-to-upper faced relation, the slide fastener halves on the slippers being thereafter jointed to connect the two slippers together. In this storage configuration, the slipper soles constitute the outer side walls of the package.

10 Claims, 3 Drawing Figures

STORABLE SLIPPERS

This invention relates to shoe structures. More particularly, this invention relates to a storable slipper structure.

Slippers are, of course, very well known to the prior art. Basically, a slipper is a light weight shoe made in various styles normally for indoor, e.g., bedroom, wear. But certain types of slippers are also made for use outdoors. More specifically, a slipper is in the nature of a low cut shoe that is easily slipped on the user's foot, and is generally held to the user's foot by means of the upper without the aid of lacing or other fastener means.

Perhaps the most common use of slippers is a bedroom use, slippers for this use commonly being referred to as bedroom slippers. This type of informal slipper use is common in residential homes. Oftentimes slipper owners wish to take bedroom slippers along while travelling for use in hotel or motel rooms, or the like. This type slipper is commonly referred to as travel slippers. In order to prevent the two slippers of a pair of travel slippers from becoming lost relative one to another, it is common to provide a case for the slippers. The case, of course, is a separate structural element from the two slippers, and may tend to become lost, or otherwise misplaced, over a period of time.

It is the primary objective of this invention to provide a shoe structure that incorporates a novel concept for holding a pair of shoes in a storage position without the use of a carrying case or the like. In accord with this objective, and in preferred form when the invention is applied to slippers, each slipper is provided with one-half of a slide fastener on the periphery of the slipper's sole. When storage is desired, the slippers are oriented toe-to-toe and heel-to-heel, the uppers of the two slippers are simply laid together one against the other, and the two slide fastener halves connected together in normal slide fastener fashion. In this configuration, the soles of the slippers constitute the outer faces of the stored slipper package, and the slipper interiors are protected from, e.g., dust and the like.

Other objectives and advantages of this invention will be more apparent from the following detailed description in which.

Figure 1:
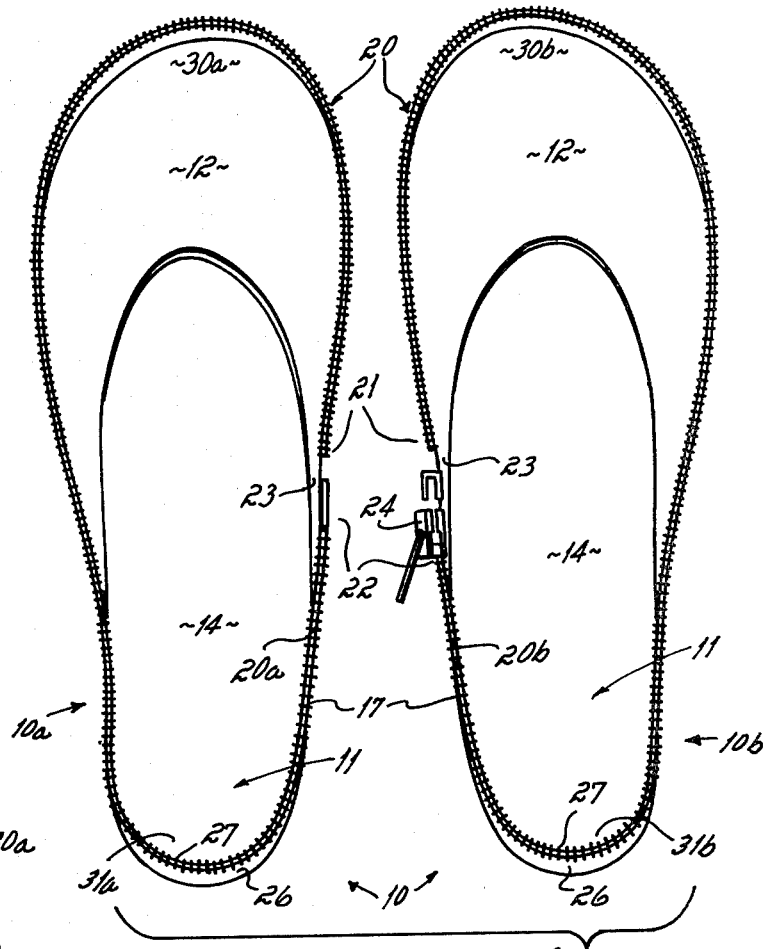
FIG. 1 is a perspective view illustrating a pair of slippers structured in accord with the principles of this invention, and in the open or use position.

As shown in the figures of this application, each slipper 10 of a pair 10*a*, 10*b* is in the nature of a low cut shoe that is easily slipped on the foot. Each slipper 10 is comprised of a sole 11 and an upper 12, the slipper being held to the user's foot by means of the upper only without the aid of lacing or the like. The slipper 10 illustrated is in the nature of a bedroom syle slipper for informal indoor wear, and is particularly adapted for use as a travel slipper in accord with the principles of this invention.

Each slipper sole 11 is comprised of an outer sole 13 and an inner sole 14, the soles 13, 14 being separated one from another by a cushion like pad 15 and being connected together by a first peripheral stitch line 16. The inner sole 14, and the pad 15 are secured to an intermediate sole panel 18 by, e.g., an adhesive, on the underside of the sole 14 and pad 15 combination.

Each slipper upper 12 is of a very flexible material, e.g., fabric or soft leather, and is connected to the sole 11 of the slipper 10 along the same stitch line 16 that stitches the inner 14 and outer 13 soles of the slipper into connected relation.

A slide fastener 20, i.e., fastener means, is disposed around the outer periphery 17 of the slippers 10. Each slipper 10*a*, 10*b* carries one-half 20*a*, 20*b* of the slide fastener. Note that each half 20*a*, 20*b* of the slide fastener begins at 21 and ends at 22 in close proximity on the instep edge portion 23 of the slipper's sole 11, i.e., each fastener half is disposed in closed loop fashion around a sole's outer periphery 17. Of course, one half 20*a* of the slide fastener 20 carries the slide piece or connector 24, and the slide fastener half 20*b* on the other slipper 10*b* does not have a slide piece. The slide fastener 20 provides a sturdy and continuous closure for the slippers 10*a*, 10*b* when they are connected together one on top of the other.

More particularly, the slide fastener 20 may be of the type in which two sets of interlocking teeth are of the same design, the teeth commonly being made of metal or nylon. Also, the slide fastener may be of the tongue and groove all plastic type which differs in structure, but is identical in function. In the embodiment shown, each half of the slide fastener 20 is comprised of a strip 26 of cloth tape having a row of metal or plastic teeth 27 on the exposed edge thereof. The cloth tape 26 is sewn to the outer sole 13 along a second peripheral stitch line 25. One of the rows of teeth 27 is provided with a slide piece 24 that, when the teeth are juxtaposed into a potential closure relation, connects the two teeth rows of the two fastener halves 20*a*, 20*b* together by drawing the teeth into an interlocking position in usual slide fastener fashion.

Figure 2:
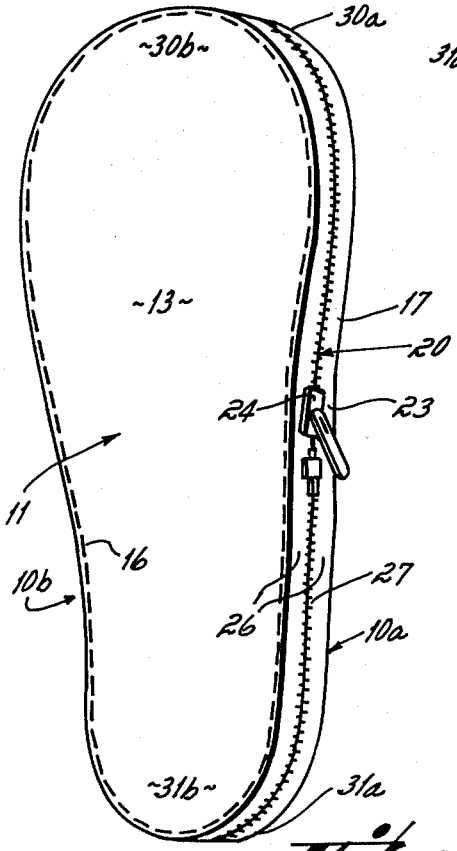
FIG. 2 is a perspective view showing the FIG. 1 pair of slippers in the storage position.
Figure 3:
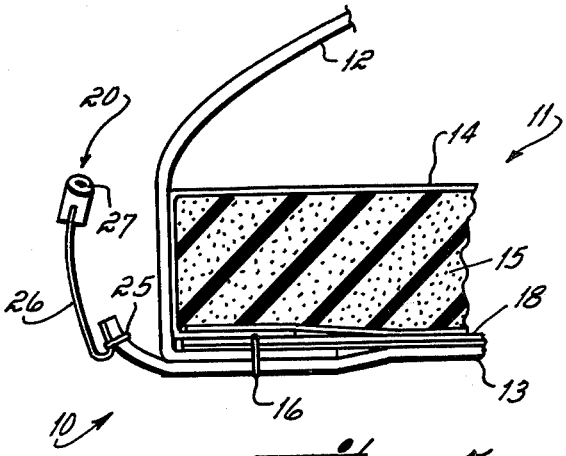
FIG. 3 is a cross-sectional view illustrating attachment of a slide fastener to a slipper.

When it is desired to wear the slippers 10 of this invention, the slippers are disposed as shown in FIG. 1 so that the user can simply slip on the left foot slipper 10*a* and right foot slipper 10*b* as desired. When storage of the slippers 10 is desired, the two slipper halves 10*a*, 10*b* are positioned one on top of the other with the slippers oriented toe-30*a*-to-toe-30*b* and heel-31*a*-to-heel-31*b*. In the storage position the slippers are also oriented so that the uppers 12 of the two slippers 10*a*, 10*b* are laid face-to-face against one another. Since the uppers 12 are flexible and readily deformable, this allows the soles 11*a*, 11*b* to be oriented in generally parallel plane relation. Subsequently, the slide piece 24 connects the teeth 27 of the two slide fastener havles 20*a*, 20*b* in normal slide fastener fashion simply by moving the slide piece around the periphery 17 of the two slipper soles 11. In the stowed or storage configuration so formed, and as shown in FIG. 2, the soles 11*a*, 11*b* of the slippers constitute the outer faces of the package. This protects the interior areas 33 of the slippers from, e.g., dust and the like, and presents relatively flat, smooth side wall faces for the package so formed. Further, and importantly, this novel structure eliminates the necessity for a separate carrying case or storage case for the slippers.

Having described in detail the preferred embodiment of my invention, what I desire to claim and protect by Letters Patent is:

1. A pair of shoes comprising a right foot shoe and a left foot shoe, and a fastener connected to each of said shoes, said fasteners cooperating to connect said right and left shoes together in a storage configuration where the shoe uppers are in face-to-face relation, and where the shoe soles constitute the outer faces, in the storable package so formed when storage of the shoes is desired by a user.

2. A pair of shoes as set forth in claim 1, said shoes being oriented in a toe-to-toe and heel-to-heel orientation in the storage configuration.

3. A pair of shoes as set forth in claim 1, said right and left shoes each including a flexible upper, said uppers being compressable together one against the other when said shoes are connected together.

4. A pair of shoes as set forth in claim 1, said fastener on each of said shoes being oriented in a generally closed loop on each shoe.

5. A pair of shoes as set forth in claim 4, said closed loop constituting the sole periphery on each of said shoes.

6. A pair of shoes as set forth in claim 1, said fasteners comprising a slide fastener.

7. A pair of shoes as set forth in claim 6, each half of said slide fastener being connected in substantially closed loop fashion around the sole periphery on each of said shoes.

8. A pair of shoes as set forth in claim 7, each slide fastener half beginning and ending in the instep portion of each shoe's sole periphery.

9. A pair of shoes as set forth in claim 7, each slide fastener half being connected to a shoe by the same stitch line used in fabricating the sole of that shoe.

10. A pair of shoes as set forth in claim 6, said shoes being in the form of slippers.

* * * * *